US005476829A

United States Patent [19]

Taylor et al.

[11] Patent Number: 5,476,829

[45] Date of Patent: Dec. 19, 1995

[54] PRESSURE-SENSITIVE COPYING MATERIAL

[75] Inventors: David J. Taylor; Margaret P. Templey, Thame; Ivan Sheiham, Marlow, all of England

[73] Assignee: The Wiggins Teape Group Limited, England

[21] Appl. No.: 269,770

[22] Filed: Jul. 1, 1994

[30] Foreign Application Priority Data

Jul. 3, 1993 [GB] United Kingdom ..... 9313790

[51] Int. Cl.[6] ..... B41M 5/165

[52] U.S. Cl. ..... 503/201; 503/200; 503/213; 503/215; 503/223; 503/224; 503/225

[58] Field of Search ..... 427/150; 503/213, 503/215, 225, 200, 201, 223, 224

[56] References Cited

U.S. PATENT DOCUMENTS

| | | | |
|---|---|---|---|
| 2,712,507 | 7/1955 | Green | 503/215 |
| 2,730,457 | 1/1956 | Green et al. | 503/213 |
| 2,800,457 | 7/1957 | Green et al. | 503/215 |
| 2,800,458 | 7/1957 | Green et al. | 503/215 |
| 3,016,308 | 1/1962 | Macaulay | 503/213 |
| 3,041,289 | 6/1962 | Katchen et al. | 503/215 |
| 3,753,761 | 8/1973 | Sugahara et al. | 503/225 |
| 4,001,140 | 1/1977 | Foris et al. | 503/215 |
| 4,100,103 | 7/1978 | Foris et al. | 503/215 |
| 4,105,823 | 8/1978 | Hasler et al. | 503/215 |
| 4,154,463 | 5/1979 | Burri | 503/220 |
| 4,335,013 | 6/1982 | Allart et al. | 252/364 |
| 4,387,117 | 6/1983 | Shanton | 427/150 |
| 4,391,850 | 7/1983 | Shanton | 427/150 |
| 4,396,670 | 8/1983 | Sinclair | 503/215 |
| 4,405,371 | 9/1983 | Sugahara et al. | 106/21 |
| 4,611,070 | 9/1986 | Oberlinner | 549/344 |
| 4,629,800 | 12/1986 | Yonese et al. | 549/226 |
| 4,783,196 | 11/1988 | Eckstein et al. | 8/527 |
| 4,859,650 | 8/1989 | Hilterhaus et al. | 503/213 |
| 4,923,641 | 5/1990 | Eckstein et al. | 544/86 |
| 5,094,688 | 3/1992 | Eckstein et al. | 106/21 |
| 5,178,949 | 1/1993 | Sakamoto et al. | 428/402.2 |
| 5,190,909 | 3/1993 | Shanton et al. | 503/218 |
| 5,209,947 | 5/1993 | Taylor et al. | 427/150 |
| 5,281,266 | 1/1994 | Sheiham et al. | 106/211 |
| 5,304,242 | 4/1994 | Taylor | 106/483 |

FOREIGN PATENT DOCUMENTS

| | | | |
|---|---|---|---|
| 86636 | 8/1983 | European Pat. Off. | 503/215 |
| 144472 | 6/1985 | European Pat. Off. | 503/225 |
| 486749 | 5/1992 | European Pat. Off. | 503/224 |
| 573210 | 12/1993 | European Pat. Off. | 503/213 |
| 49-31414 | 3/1974 | Japan | 503/213 |
| 51-080685 | 7/1976 | Japan | 503/213 |
| 59-164186 | 3/1983 | Japan | 503/215 |
| 02/039987 | 7/1988 | Japan | 503/223 |
| 02/185489 | 1/1989 | Japan | 503/224 |
| 03/024992 | 6/1989 | Japan | 503/224 |
| 04/253779 | 9/1992 | Japan | 503/215 |
| 74/3090 | 5/1974 | South Africa | 503/215 |
| 1221489 | 2/1971 | United Kingdom | 503/215 |
| 1221571 | 2/1971 | United Kingdom | 503/215 |
| 1222016 | 2/1971 | United Kingdom | 503/215 |
| 2220671 | 1/1990 | United Kingdom | 503/220 |

*Primary Examiner*—B. Hamilton Hess
*Attorney, Agent, or Firm*—Burns, Doane, Swecker & Mathis

[57] ABSTRACT

Pressure-sensitive copying material utilizes a blend of rapid- and slow-developing chromogenic materials in vegetable oil solvent and an acid clay or synthetic inorganic color developer. The surface pH of the color developer is not more than 8.7, which gives rise to enhanced image intensity and fade resistance compared with the use of conventional higher color developer surface pH values.

12 Claims, No Drawings

PRESSURE-SENSITIVE COPYING MATERIAL

This invention relates to pressure-sensitive copying material, particularly carbonless copying paper.

Pressure-sensitive copying material is well-known and is widely used in the production of business forms sets. Various types of pressure-sensitive copying material are known, of which the most widely used is the transfer type. A business forms set using the transfer type of pressure-sensitive copying material comprises an upper sheet (usually known as a "CB" sheet) coated on its lower surface with microcapsules containing a solution in an oil solvent or solvent composition of at least one chromogenic material (alternatively termed a colour former) and a lower sheet (usually known as a "CF" sheet) coated on its upper surface with a colour developer composition. If more than one copy is required, one or more intermediate sheets (usually known as "CFB" sheets) are provided, each of which is coated on its lower surface with microcapsules and on its upper surface with colour developer composition. Imaging pressure exerted on the sheets by writing, typing or impact printing (e.g. dot matrix or daisy-wheel printing) ruptures the microcapsules, thereby releasing or transferring chromogenic material solution on to the colour developer composition and giving rise to a chemical reaction which develops the colour of the chromogenic material and so produces a copy image.

In a variant of the above-described arrangement, the solution of chromogenic material may be present as isolated droplets in a continuous pressure-rupturable matrix instead of being contained within discrete pressure-rupturable microcapsules.

In another type of pressure-sensitive copying system, usually known as a self-contained or autogenous system, microcapsules and colour developing co-reactant material are coated onto the same surface of a sheet, and writing or typing on a sheet placed above the thus-coated sheet causes the microcapsules to rupture and release the solution of chromogenic material, which then reacts with the colour developing material on the sheet to produce a coloured image.

The solvents used to dissolve the chromogenic materials in pressure-sensitive copying materials as described above have typically been hydrocarbon products derived from petroleum or coal deposits, for example partially hydrogenated terphenyls, alkyl naphthalenes, diarylmethane derivatives, or dibenzyl benzene derivatives or derivatives of hydrocarbon products, for example chlorinated paraffins. These "prime solvents" are usually mixed with cheaper diluents or extenders such as kerosene, which although of lesser solvating power, give rise to more cost-effective solvent compositions.

Vegetable oils have also been disclosed as solvents for use in pressure-sensitive copying materials. Whilst such disclosures go back many years, it is only very recently that the use of such oils has been commercialized, to the best of our knowledge.

Examples of patent literature disclosures of vegetable oils as solvents in pressure-sensitive copying material are U.S. Pat. Nos. 2,712,507 (column 3, lines 55 and 56); 2,730,457 (column 5, lines 30 and 31); and 3,016,308 (column 6, Table 1); 4,783,196 (column6); and 4,923,641 (column6); and European Patent Applications Nos. 86636A (page 4), 155593A (page 11), 234394A (page 11, first three lines)and, especially, European Patent Applications Nos. 262569A; 520639A and 573210A. The three last-mentioned are of particular interest as they are primarily concerned with the use of vegetable oil solvents in pressure-sensitive copying paper. In contrast, the main subject of the other patent references mentioned above was not the solvent compositions at all.

In commercial production of pressure-sensitive copying material, it has been conventional to use a mixture of different chromogenic materials in order to achieve a copy image which, inter alia, develops rapidly, retains its intensity over time (i.e. is not destroyed by fading), has a particular desired hue and is photocopiable. The most commonly used chromogenic materials are phthalides, particularly crystal violet lactone (CVL), and fluorans.

CVL is important because it is relatively cheap in comparison with other chromogenic materials and also develops a strong blue colour virtually instantaneously on contact with the surface of the CF paper. However, it has the major drawback that the developed blue image fades markedly over time with exposure to light when an acid clay or other inorganic colour developer is used. This fading has hitherto been counteracted by the inclusion of one or more additional blue-developing chromogenic materials which develop colour more slowly but which are more resistant to fading. Thus in simple terms, the gradual loss of overall image intensity which would result from fading of the colour derived from CVL is compensated by the increasing intensity of the image derived from the slower-developing blue chromogen(s).

Whilst the inclusion of these additional slower-developing chromogenic materials has proved satisfactory with conventional hydrocarbon solvents, we have experienced difficulty when seeking to apply the same technique to solvent compositions based on vegetable oils. In particular, the currently most widely-used slow developing blue chromogenic material, namely N-butylcarbazol-3-yl-bis(4-N-methyl-N-phenylaminophenyl)methane ("Carbazolyl Blue"), has so far been found to be largely ineffective when used in solvent compositions based on vegetable oils and in conjunction with typical acid-clay colour developer papers.

We have now found that the colour-generating effectiveness of the aforementioned slow-developing blue chromogenic material, and also of other slow-developing chromogenic materials, when used in vegetable oil solvents and with acid clay and other inorganic colour developers, can be significantly and usefully increased by applying the colour developer formulation to the base paper at a significantly lower pH than has hitherto been conventional in the manufacture of pressure-sensitive copying materials employing inorganic colour developers. This results in a colour developer surface pH which is also lower than is conventional. The use of a low colour developer surface pH in pressure-sensitive copying materials as just described gives benefits both in terms of intensity of colour development achieved and resistance to fading of the colour once developed.

The mix formulation pH influences the surface pH of the final colour developer paper,but we have found that appropriate choice of mix formulation is not the only factor to be taken into account in seeking to achieve a desired colour developer surface pH. Different types of base papers give rise to different colour developer surface pH values with the same colour developer mix pH, and even with nominally similar base papers and colour developer formulations, it can be difficult to achieve reproducible colour developer surface pH values. These factors make it expedient to consider colour developer surface pH rather than mix formulation pH when assessing imaging performance, even though mix formulation pH is the primary factor to be taken into account when seeking to achieve a particular desired colour developer pH (it will be appreciated that in view of the factors just discussed, a certain amount of trial and error may be needed to achieve precise desired surface pH levels).

A further complication which arises when assessing colour developer surface pH is that it can change significantly with time, probably as a result of absorption of atmospheric carbon dioxide, acid-transfer from the base paper (in the case of an acid-sized base paper) and the influence of the acid colour developer material which gradually counteracts that of the alkali used to adjust mix pH. It is therefore desirable to consider the colour developer surface pH at the time of use of the paper for copy imaging rather than just the surface pH immediately after manufacture of the paper. Use for copy imaging typically does not occur for some months after the paper has been manufactured, as a result of delays in the distribution chain from manufacturer to paper merchant to business forms printer and of storage of forms before use.

In view of the factors just discussed, it is difficult to determine a precise colour developer surface pH threshold below which benefits are obtained compared with current commercially available acid clay colour developer papers (our measurements show that these typically have a surface pH greater than 9 at the time at which they are put on the market, converted into business forms or are used, especially when the base paper used is alkaline-sized rather than acid-sized). We have found that surface pH values below 8.5 give the most benefits, but that some benefit is obtained above this, for example at a surface pH value of about 8.7.

Accordingly, the present invention provides pressure-sensitive copying material comprising a sheet support carrying isolated droplets of an oil solution of chromogenic materials, said droplets being confined within respective pressure-rupturable barriers, and, on the opposite surface of the same sheet or on a different sheet support, a coating of an inorganic colour developer material effective to develop the colour of the chromogenic materials in said solution on contact therewith, at least one of said chromogenic materials having the characteristic of developing colour immediately on contact with the colour developer, characterized in that:

a) the oil solution comprises vegetable oil solvent;

b) the solution of chromogenic materials includes at least one chromogenic material which is relatively slower in developing colour on contact with the colour developer than the above-mentioned immediately-developing chromogenic material(s); and c) the surface pH of the colour developer coating is not more than about 8.7, preferably not more than 8.4 or 8.5.

The pressure-rupturable barrier within which each isolated droplet of chromogenic material solution is confined is typically the wall of a microcapsule, but may be part of a continuous pressure-rupturable matrix as referred to earlier.

We have found that the invention provides best results when the base paper is alkaline- or neutral-sized (typically with alkyl ketene dimer), but that a benefit is still obtained when the base paper is acid-sized (typically rosin-alum sized). As mentioned earlier, the nature of the sizing system used in the base paper influences the surface pH of the colour developer coating to some extent. Thus a conventional acid clay colour developer composition will produce a dry coating of higher surface pH when applied to an alkaline-sized paper than when applied to an acid-sized base paper. So far as we are aware, there has been no previous commercial use of acid-sized colour developer paper in conjunction with vegetable oil-based chromogenic material solutions.

The inorganic colour developer for use in the present invention is typically an acid-washed dioctahedral montmorillonite clay, for example as disclosed in British Patent No. 1213835. Alternatively, or in addition, other acid clays may be used, as can so-called semi-synthetic inorganic developers as disclosed for example, in European Patent Applications Nos. 44645A and 144472A, or alumina/silica colour developers such as disclosed in our European Patent Applications Nos. 42265A, 42266A, 434306A, or 518471A, or as sold under the trademark "Zeocopy" by Zeofinn Oy, of Helsinki, Finland. All of the above-mentioned inorganic colour developers can be used in conjunction with inert or relatively inert extenders such as calcium carbonate, kaolin or aluminium hydroxide.

The vegetable oil for use in the present invention may be a normally liquid oil such as rapeseed oil (RSO), soya bean oil (SBO), sunflower oil (SFO), groundnut oil (GNO), cottonseed oil (CSO), corn oil (CO) safflower oil (SAFO) or olive oil (OLO). However, vegetable oils of a melting point such that they are solid or semi-solid at room temperature are particularly advantageous, as is disclosed in our European Patent Application No. 573210A. Such solid oils include coconut oil (CNO), palm oil (PO), palm kernel oil (PKO) and hardened vegetable oils such as hardened soya bean oil (HSBO) or hardened coconut oil (HCNO). Blends of more than one of the aforementioned oils may be used.

The vegetable oil may be used in a blend with a proportion of a fatty acid ester or other mono- or di-functional ester of a non-aromatic mono-carboxylic acid having a saturated or unsaturated straight or branched hydrocarbon chain with at least three carbon atoms in the chain, as disclosed in our European Patent Application No. 520639A.

The solvent for the chromogenic material solution preferably consists essentially of vegetable oil and, optionally, an ester as defined in the previous paragraph, and is thus substantially free of hydrocarbon or chlorinated hydrocarbon oils as are currently widely used in pressure-sensitive copying papers.

Relatively slower developing chromogenic materials suitable for use in the present invention include:

1) Mono-carbazolyl diphenyl methane derivatives such as:

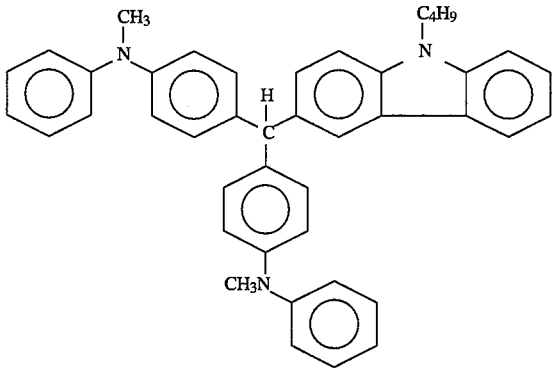

(I)

N-butylcarbazol-3-yl-bis(4-N-methyl-N-phenylaminophenyl)methane ("Carbazolyl Blue").

As previously mentioned, this chromogenic material is widely used in pressure-sensitive copying material at the present time. Its synthesis and that of structurally-related chromogenic materials is disclosed in British Patent No. 1548059 (see especially Manufacturing Example J).

Other suitable mono-carbazolyl diphenyl methane derivatives are:

1a)

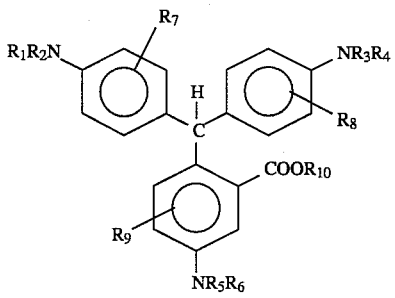

(II)

A compound of this general formula is available as a development sample from Hodogaya Chemical Company of Tokyo, Japan, under the name "Blue SDCF", but we are not aware of the nature of all the substituents $R_1$ to $R_{10}$. Further details of this compound are to be found in European Patent Application No. 486749A.

1b)

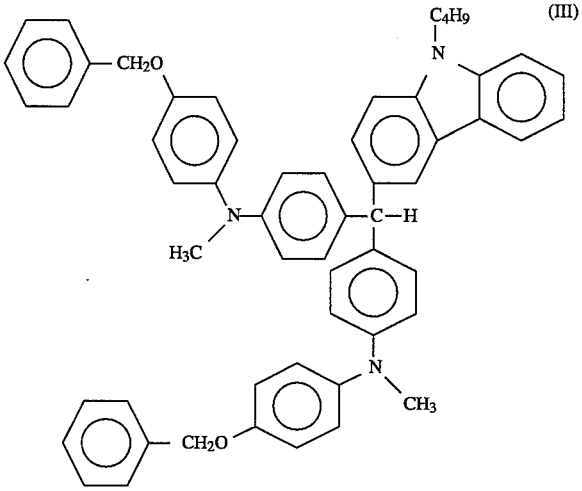

(III)

This compound is the subject of Example 2 of British Patent Application No. 2220671A, equivalent to Japanese Laid-Open Patent Application No. 02-26782A.

2) Spiro-bipyran derivatives such as:

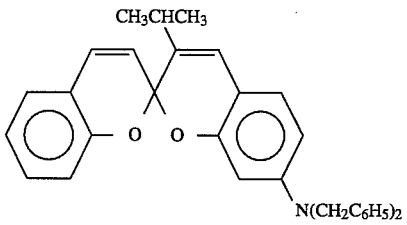

(IV)

3-i-propyl-7-dibenzylamino-2,2'-spirobi-[2H-1-benzopyran].

This has been commercially used in pressure-sensitive copying material. It provides a blue developed image, and its speed of development is intermediate between immediately-developing phthalides and fluorans and the slow developing compound (I) above. Its synthesis and that of structurally-related chromogenic materials is disclosed in European Patent Application No. 10740A (see especially Example 2).

3)

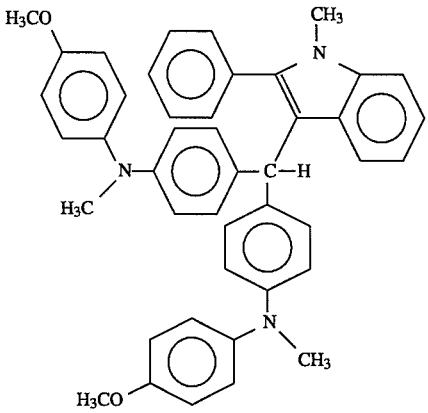

(V)

This compound is the Subject of Synthesis Example 1 of Japanese Laid-Open Patent Application No. 02-39987A.

4)

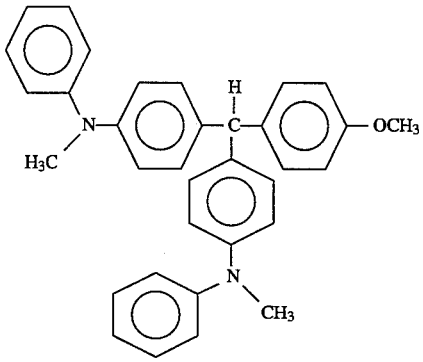

(VI)

This compound is Compound No. 1 disclosed in Japanese Laid-Open Patent Application No. 02-185489A.

5)

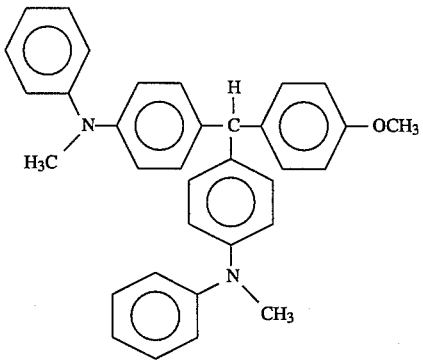

(VII)

This compound is Compound No. 1 disclosed in Japanese Laid-Open Patent Application No. 03-24992A.

6)

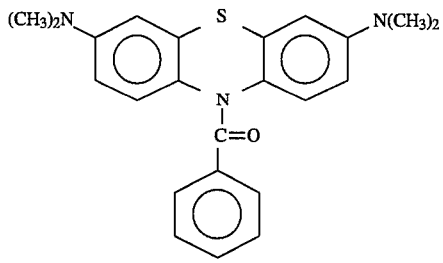

(VIII)

Benzoyl Leuco Methylene Blue (BLMB)—10 Benzoyl-3,7-bis (dimethylaminophenothiazine).

This colour former was widely used when pressure-sensitive copying material was first commercialized, and for some time afterwards. It is rarely used in pressure-sensitive copying material nowadays, but is still commercially available, for example from Hodogaya Chemical Company of Tokyo, Japan.

7) Vinyl carbinols or derivatives thereof as disclosed generally in our European Patent Application No. 429329A, for example.

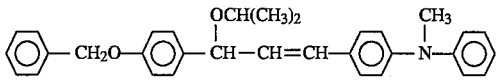

(IX)

The speed of development of this class of vinyl carbinol or carbinol derivative colour formers varies considerably depending on the nature of the substituent groups, but is always slower than immediately-developing phthalides such as CVL and fluorans.

8) Triphenylmethane carbinols as disclosed in U.S. Pat. Nos. 4,783,196 and 4,923,641 and or carbazolyldiphenylmethane carbinols as disclosed in European Patent Application No. 303942A. An example of the latter is:

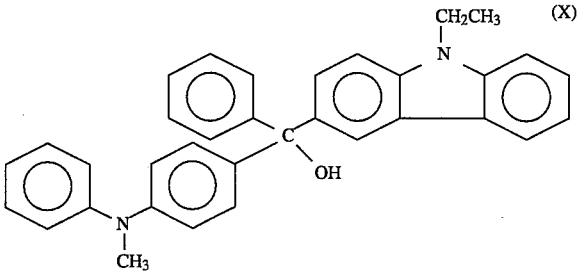

(X)

This compound forms the subject of Example 2 of European Patent Application No. 303942A.

The immediately-developing chromogenic material(s) which can be used in the present invention include phthalides such as CVL and 3,3-bis (1-octyl-2-methylindol-3-yl)phthalide and fluoran derivatives, particularly fluorans substituted in the 2 and 6 positions on the fluoran ring structure with substituted amino group.

In use, the present solvent composition, containing dissolved chromogenic materials, is microencapsulated and used in conventional manner.

In addition to the chromogenic materials dissolved in the oil solution, other additives ! may in principle be present, for example antioxidants to counteract the well known tendency of vegetable oils to deteriorate as a result of oxidation, provided these are compatible with the chromogenic materials and encapsulation process used.

The microcapsules may be produced by coacervation of gelatin and one or more other polymers, e.g. as described in U.S. Pat. Nos. 2,800,457; 2,800,458; or 3,041,289; or by in situ polymerisation of polymer precursor material, e.g. as described in U.S. Pat. Nos. 4,001,140; 4,100,103; 4,105,823 and 4,396,670.

The chromogen-containing microcapsules, once produced, are formulated into a coating composition with a suitable binder, for example starch or a starch/carboxymethylcellulose mixture, and a particulate agent (or "stilt material") for protecting the microcapsules against premature microcapsule rupture. The stilt material may be, for example, wheatstarch particles or ground cellulose fibre floc or a mixture of these. The resulting coating composition is then applied by conventional coating techniques, for example metering roll coating or air knife coating.

Apart from the solvent composition and the surface pH of the colour developer coating, the present pressure-sensitive copying paper may be conventional. Such paper is very widely disclosed in the patent and other literature, and so requires only brief further discussion.

The thickness and grammage of the present paper (before microcapsule coating) may be as is conventional for this type of paper, for example the thickness may be about 60 to 90 microns and the grammage about 35 to 50 g $m^{-2}$, or higher, say up to about 100 g $m^{-2}$, or even more. This grammage depends to some extent on whether the final paper is for CB or CFB use. The higher grammages just quoted are normally applicable only to speciality CB papers.

The invention will now be illustrated by the following Examples, in which all parts and percentages are by weight unless otherwise stated.

EXAMPLE 1

Three acid clay colour developer formulations were prepared at different pH values (8, 9 and 10) and were each applied to conventional alkyl ketene dimer sized carbonless base paper to produce CF paper. The grammage of the base paper was 48 g $m^{-2}$, and the dry colour developer coatweight was 7.5 g $m^{-2}$. Each colour developer formulation contained, on a dry basis, 59.5% acid-washed montmorillonite colour developer clay ("Silton" supplied by Mizusawa of Japan), 25.5% Kaolin extender and 15% styrene-butadiene latex binder, and was applied at around 48% solids content. Sodium hydroxide was used for pH adjustment, the amount required being of the order of 2 to 3%, depending on the final mix pH required.

The above general procedure was then repeated using an alumina/silica colour developer ("Zeocopy" 133 supplied by Zeofinn Oy of Helsinki, Finland) in place of the acid clay. Each colour developer formulation contained, on a dry basis 59.5% silica/alumina, 25.5% kaolin, and 15% latex.

The surface pH values of the final CF products were determined using a pH meter fitted with a surface pH electrode and the results were as set out in Table 1a below.

TABLE 1a

| Colour Developer | Mix pH | Surface pH |
|---|---|---|
| Acid clay | 8.0 | 7.8 |
| Acid clay | 9.0 | 8.4 |
| Acid clay | 10.0 | 9.1 |
| Alumina/silica | 8.0 | 7.9 |
| Alumina/silica | 9.0 | 8.3 |

TABLE 1a-continued

| Colour Developer | Mix pH | Surface pH |
|---|---|---|
| Alumina/silica | 10.0 | 9.1 |

The CF papers were then each subjected to Calender Intensity (CI) testing in a pressure-.sensitive copying paper couplet (i.e. a CB-CF set) with a CB paper carrying an encapsulated 1% solution of chromogenic material (I) (referred to earlier) in a 100% RSO solvent.

In the CI test, a strip of CB paper is placed on a strip of CF paper, and the strips are passed together through a laboratory calender to rupture the capsules and thereby produce a colour on the CF strip. The reflectance (I) of the thus-coloured strip is measured and the result ($^{I}/_{Io}$) is expressed as a percentage of the reflectance of an unused control CF strip ($I_o$). Thus the lower the calender intensity value ($^{I}/_{Io}$), the more intense the developed colour.

Reflectance measurements were done at intervals after calendering over a period of three weeks, the sample being kept in the dark prior to testing. It will be understood however that for practical purposes, the results over the first 2 to 4 day period are the most important, since it is essential that by the end of this time, the slower developing chromogenic materials must have developed in order to compensate for loss of image intensity resulting from fading of the colour developed by the rapidly-developing chromogenic materials.

After each reflectance measurement had been made, the developed image was exposed for 8 hours in a cabinet in which were an array of daylight fluorescent strip lamps. This is thought to simulate in accelerated form the fading which would be likely to occur under normal conditions of use of imaged pressure-sensitive copying paper. Once the eight hours exposure was complete the reflectance was re-measured.

It should be noted that light from fluorescent strip lamps can stimulate development of the colour of chromogenic material (I). Thus in some cases the colour obtained after simulated fading is more intense than before simulated fading.

The results obtained in the initial CI test and after 8 hours fade testing are set out in Tables 1b and 1c below:

TABLE 1b

| Colour Devel- | CF Surface | CI after stated no. of days development | | | | | | | |
|---|---|---|---|---|---|---|---|---|---|
| oper | pH | 0 | 1 | 2 | 3 | 4 | 7 | 14 | 21 |
| Acid | 7.8 | 100 | 98.9 | 91.0 | 85.4 | 84.5 | 81.6 | 80.9 | 80.8 |
| Clay | 8.4 | 100 | 98.9 | 90.5 | 86.0 | 84.4 | 81.5 | 81.1 | 79.8 |
| | 9.1 | 100 | 99.9 | 94.2 | 90.2 | 88.6 | 87.5 | 83.7 | 83.9 |
| Alum./ | 7.9 | 100 | 99.4 | 77.2 | 77.2 | 79.0 | 79.5 | 84.3 | 81.1 |
| Silica | 8.3 | 100 | 99.8 | 85.1 | 82.6 | 84.7 | 83.0 | 90.2 | 90.4 |
| | 9.1 | 100 | 99.7 | 94.9 | 93.2 | 92.9 | 92.9 | 94.2 | 92.3 |

TABLE 1c

| Colour Devel- | CF Surface | Reflectance after 8 hours fade testing after stated no. of days development | | | | | | | |
|---|---|---|---|---|---|---|---|---|---|
| oper | pH | 0 | 1 | 2 | 3 | 4 | 7 | 14 | 21 |
| Acid | 7.8 | 89.9 | 88.7 | 86.3 | 83.9 | 83.5 | 80.4 | 80.9 | 80.7 |
| Clay | 8.4 | 90.7 | 88.8 | 86.1 | 84.8 | 83.2 | 80.0 | 79.5 | 79.5 |
| | 9.1 | 93.7 | 92.5 | 89.8 | 86.7 | 86.1 | 84.3 | 82.4 | 82.6 |
| Alum./ | 7.9 | 89.2 | 86.7 | 78.0 | 78.9 | 79.8 | 80.9 | 85.1 | 82.7 |
| Silica | 8.3 | 93.1 | 91.0 | 84.9 | 84.3 | 85.4 | 84.4 | 90.7 | 91.0 |
| | 9.1 | 97.5 | 96.7 | 94.0 | 92.5 | 92.3 | 92.7 | 94.0 | 92.1 |

It will be seen that in each case the papers of lower surface pH (according to the invention) gave more intense colouration, both before and after fading, than the higher surface pH paper (conventional).

EXAMPLE 2

This illustrates the present invention with different vegetable oils from that used in Example 1, namely CNO and SFO, and also with a 1:1 blend of RSO and 2-ethylhexylcocoate (EHC), as described in our European Patent Application No. 520639A. The procedure was as described in Example 1 except that tests were carried out only with acid clay CF paper. Coconut oil is solid at ambient temperatures, but its encapsulation presents no difficulty if it is melted prior to encapsulation (further information can be obtained, if needed, from our European Patent Application No. 573210A.

The results are set out in Tables 2a and 2b below.

TABLE 2a

| Solvent | CF surface pH | CI after stated no. of days development 0 | 1 | 2 | 3 | 4 | 7 | 14 | 21 |
|---|---|---|---|---|---|---|---|---|---|
| CNO | 7.8 | 100 | 99.4 | 88.8 | 86.0 | 85.4 | 83.5 | 84.1 | 84.1 |
| | 8.4 | 100 | 99.7 | 92.3 | 87.6 | 85.8 | 84.5 | 84.1 | 83.7 |
| | 9.1 | 100 | 100 | 94.8 | 92.5 | 91.5 | 90.1 | 86.3 | 86.3 |
| SFO | 7.8 | 100 | 98.7 | 91.6 | 86.8 | 86.2 | 84.6 | 84.1 | 83.0 |
| | 8.4 | 100 | 98.7 | 91.3 | 87.9 | 86.6 | 84.6 | 84.0 | 82.9 |
| | 9.1 | 100 | 99.3 | 94.6 | 92.6 | 90.4 | 88.4 | 86.3 | 86.2 |
| RSO/EHC | 7.8 | 100 | 88.5 | 88.0 | 86.5 | 85.7 | 84.5 | 84.0 | 84.7 |
| | 8.4 | 100 | 88.3 | 88.4 | 86.4 | 85.8 | 84.6 | 84.4 | 84.5 |
| | 9.1 | 100 | 89.9 | 89.1 | 89.0 | 87.4 | 86.2 | 85.3 | 85.5 |

TABLE 2b

| Solvent | CF Surface pH | Reflectance after 8 hours fade testing after stated no. of days development 0 | 1 | 2 | 3 | 4 | 7 | 14 | 21 |
|---|---|---|---|---|---|---|---|---|---|
| CNO | 7.8 | 90.9 | 88.7 | 85.1 | 84.6 | 83.7 | 82.3 | 83.0 | 83.6 |
| | 8.4 | 91.9 | 89.7 | 86.6 | 83.8 | 83.4 | 82.8 | 82.7 | 83.1 |
| | 9.1 | 94.9 | 93.3 | 90.0 | 88.9 | 87.5 | 86.6 | 84.8 | 85.1 |
| SFO | 7.8 | 90.5 | 89.7 | 86.4 | 84.9 | 84.9 | 83.3 | 84.0 | 82.5 |
| | 8.4 | 91.6 | 89.3 | 86.3 | 84.9 | 84.6 | 83.0 | 83.8 | 82.1 |
| | 9.1 | 94.6 | 92.6 | 89.8 | 89.0 | 87.5 | 86.9 | 85.8 | 85.1 |
| RSO/EHC | 7.8 | 91.3 | 87.9 | 87.0 | 86.5 | 86.5 | 84.5 | 83.6 | 84.8 |
| | 8.4 | 92.0 | 87.6 | 87.7 | 86.0 | 86.0 | 84.5 | 83.7 | 84.4 |
| | 9.1 | 93.4 | 88.7 | 88.5 | 87.0 | 86.3 | 85.9 | 84.6 | 85.1 |

It will be seen that the lower surface pH papers gave the more intense colouration, both before and after fading, although in the case of the RSO/EHC blend the effect was not as pronounced as with the pure vegetable oils.

EXAMPLE 3

This illustrates the use of a range of different slow-developing colour formers, namely those earlier designated as nos. (II), (IV), (IX) and (X) . The solvent used was RSO and the CF papers used were as in Example 2.

The procedure employed was as described in Example 2, except that CI test measurements were made only after 2 minutes development and after 48 hours development, but not thereafter. Fade testing was then carried out on the 48 hour developed samples for periods of 4, 8, 16 and 32 hours. The results obtained are set out in Tables 3a and 3b below.

TABLE 3a

| Chromogenic Material | CF Surface pH | CI 2 min | 48 h | Reflectance after fading for: 4 hr | 8 hr | 16 hr | 32 hr |
|---|---|---|---|---|---|---|---|
| (II) | 7.8 | 99.6 | 97.8 | 89.6 | 89.7 | 90.3 | 91.3 |
| | 8.4 | 99.7 | 97.5 | 90.1 | 89.1 | 89.4 | 90.4 |
| | 9.1 | 99.6 | 95.5 | 84.8 | 85.0 | 86.7 | 88.6 |
| (IV) | 7.8 | 91.2 | 85.3 | 86.6 | 87.8 | 89.2 | 91.1 |
| | 8.4 | 94.4 | 84.3 | 85.6 | 86.7 | 88.1 | 90.2 |
| | 9.1 | 98.5 | 85.0 | 86.9 | 88.2 | 89.8 | 91.6 |
| (IX) | 7.8 | 79.3 | 77.4 | 79.6 | 80.9 | 83.2 | 84.5 |
| | 8.4 | 84.4 | 78.6 | 79.9 | 81.3 | 84.1 | 85.6 |
| | 9.1 | 94.6 | 84.4 | 86.0 | 87.8 | 90.3 | 91.5 |
| (X) | 7.8 | 89.6 | 80.1 | 81.6 | 81.8 | 82.6 | 83.3 |
| | 8.4 | 94.5 | 79.5 | 81.1 | 81.2 | 82.2 | 83.0 |

TABLE 3a-continued

| Chromogenic Material | CF Surface pH | CI 2 min | 48 h | Reflectance after fading for: 4 hr | 8 hr | 16 hr | 32 hr |
|---|---|---|---|---|---|---|---|
| | 9.1 | 98.4 | 79.8 | 82.5 | 83.3 | 85.9 | 86.7 |

It will be seen that quite substantial benefits were obtained with the lower pH CF papers for chromogenic materials (IX) and (X), but that for chromogenic material (IV) the benefit was less marked. For chromogenic material (II), the best result was obtained with the conventional high pH CF paper.

Other work with chromogenic material (IV), as described in Examples 4 and 6 below, has indicated greater benefits for chromogenic material (IV) than are suggested by the data above. These greater benefits have also been confirmed when imaging copying sets utilising the chromogenic material (IV) paper using a dot-matrix printer. We believe therefore that the above data for chromogenic material (IV) is not fully representative and for some reason understates the benefit obtained.

The position with chromogenic material (II) is rather different, in that the work in Example 4 below confirmed the results set out above. We believe however that the difference in behaviour between chromogenic material (II) and the other chromogenic materials tested is explainable on the basis of its chemical structure. Colour formation in chromogenic material (II) occurs on oxidation of the central carbon atom of the triphenylmethane structure, which forms a cationic chromophore.

An unusual feature of the structure of chromogenic material (II) is the ester group on one ring, in a position ortho to the central carbon atom. Esters typically hydrolyse under acid conditions to produce the free acid or anion. If the ester group of chromogenic material (II) is hydrolysed the resulting acid is liable to form a lactone ring with the cationic central carbon. Such a structure is colourless. Despite the alkaline pH at which it is coated, the acid clay colour developer is fundamentally acidic, and so can hydrolyse the ester of the chromogenic material, as described above. At pH 8 or 9, the clay is more acidic than at pH 10 and therefore is more liable to hydrolyse the ester. Thus more of the colourless lactone ring structure is likely to be produced at pH 8 or 9 than at pH 10, and so this particular chromogenic material is anomalous in being more effective on the higher pH paper. The results for chromogenic material (II) do not therefore undermine the more general findings on which the present invention is based.

EXAMPLE 4

This illustrates the use of a further range of slow developing chromogenic materials (certain of which have also been used in previous Examples). These chromogenic materials were those earlier designated as (I) to (VIII), and the solvent used in each case was SBO. Additionally, chromogenic material (I) was also tested in SFO.

Three acid clay colour developer formulations were prepared at different pH values and were each conventionally blade-coated on to conventional alkyl ketene dimer sized carbonless base paper and dried to give CF sheets. The base paper was as used in previous Examples. The coatweight applied was 8–9 g $m^{-2}$. Each formulation contained, on a dry basis, 58% acid-washed montmorillonite colour developer clay ("Silton AC" supplied by Mizusawa of Japan), 25% kaolin extender and 17% styrene-butadiene latex binder and was made up at around 47 to 48% solids content. Sodium hydroxide was used for pH adjustment, the amount required being of the order of 2 to 3%, depending on the final mix pH desired. The final mix pH values obtained were 10.2, 9.1 and 8.2.

The surface pH of the final CF papers were determined as in Example 1, and were as set out in table 4a below.

TABLE 4a

| Mix pH | Surface pH |
|---|---|
| 8.2 | 8.2 |
| 9.1 | 9.0 |
| 10.2 | 9.7 |

In this Example, the chromogenic material solutions were evaluated by direct application to the CF papers, rather than being encapsulated and actually tested in a CB-CF couplet as in previous Examples. This direct application technique, described in more detail below, has been established to be a reliable predictor of the behaviour of the solutions when actually used in a pressure-sensitive copying set.

In the direct application technique, the method of applying the chromogenic material solution to the CF paper was designed to ensure that a predetermined reproducible amount of solution was applied in each case. The apparatus used was a laboratory gravure coater. This consisted of a gravure plate to which excess chromogenic material solution was applied by means of a pipette. The excess was removed by running a blade over the plate, so as to leave only a fixed amount of chromogenic material solution contained=within the gravure cells. A strip of the CF paper under test was evenly pressed against the gravure plate by means of a rubber covered roller arranged to apply a reproducible pressure. The paper was then removed and stored in the dark for 48 hours to allow the slow-developing chromogenic materials to develop their colour. The absorbance of the resulting coloured area was then determined (at the wavelength of maximum absorbance, $\lambda_{max}$) using a spectrophotometer to provide a measure of the colour intensity obtained.

The coloured strip was then subjected to exposure in a fade cabinet, as described in Example 1. The exposure period was eight hours, after which the absorbance was re-measured.

The results obtained are set out in Table 4b below.

TABLE 4b

| Chromogenic Material | CF Surface pH | Absorbance Before Fading | Absorbance After Fading |
|---|---|---|---|
| (I) (SFO) | 8.2 | 0.05 | 0.08 |
| | 9.0 | 0.02 | 0.06 |
| | 9.7 | 0.02 | 0.02 |
| (I) (SBO) | 8.2 | 0.05 | 0.08 |
| | 9.0 | 0.02 | 0.04 |
| | 9.7 | 0.02 | 0.02 |
| (II) | 8.2 | 0.08 | 0.14 |
| | 9.0 | 0.06 | 0.05 |
| | 9.7 | 0.09 | 0.13 |
| (III) | 8.2 | 0.07 | 0.06 |
| | 9.0 | 0.04 | 0.04 |
| | 9.7 | 0.03 | 0.02 |
| (IV) | 8.2 | 0.22 | 0.14 |

TABLE 4b-continued

| Chromogenic Material | CF Surface pH | Absorbance Before Fading | Absorbance After Fading |
|---|---|---|---|
| | 9.0 | 0.20 | 0.10 |
| | 9.7 | 0.17 | 0.07 |
| (V) | 8.2 | 0.20 | 0.18 |
| | 9.0 | 0.13 | 0.13 |
| | 9.7 | 0.09 | 0.09 |
| (VI) | 8.2 | 0.05 | No image |
| | 9.0 | 0.03 | 0.04 |
| | 9.7 | 0.04 | No image |
| (VII) | 8.2 | 0.06 | 0.02 |
| | 9.0 | 0.01 | No image |
| | 9.7 | 0.004 | No image |
| (VIII) | 8.2 | 0.22 | 0.18 |
| | 9.0 | 0.16 | 0.15 |
| | 9.7 | 0.13 | 0.17 |

Although there appears to be some scatter in the data, it will be seen that with the exception of chromogenic material (II), the image intensity obtained with the lower pH papers was better than that with the conventional pH 9.7 paper. It should be noted in particular that more significant benefits were obtained with chromogenic material (IV) than in Example 3. The anomalous behaviour of chromogenic material (II) has already been discussed earlier.

EXAMPLE 5

This illustrates the use of further combinations of colour developer surface pH and vegetable oil type. The chromogenic material was chromogenic material (I) referred to earlier.

The procedure was generally as in Example 1 except that only acid clay colour developer formulations were used and that the longest development time prior to imaging testing was 24 days rather than 21.

The colour developer mix and surface pH values were as follows:

| Mix pH | Surface pH |
|---|---|
| 8.0 | 8.4 |
| 8.5 | 8.7 |
| 9.0 | 9.3 |

The results obtained in the initial CI test and after 8 hours fade testing are set out in Tables 5a and 5b below:

TABLE 5a

| Solvent | CF surface pH | CI after stated no. of days development 0 | 1 | 2 | 3 | 4 | 7 | 14 | 24 |
|---|---|---|---|---|---|---|---|---|---|
| CNO | 8.4 | 99.6 | 97.5 | 94.1 | 96.0 | 95.4 | 93.2 | 91.1 | 87.3 |
| | 8.7 | 99.6 | 98.5 | 98.3 | 97.9 | 97.7 | 96.0 | 94.1 | 93.7 |
| | 9.3 | 99.4 | 98.9 | 98.5 | 98.3 | 98.1 | 97.3 | 96.2 | 95.8 |
| RSO | 8.4 | 99.6 | 97.2 | 97.2 | 96.8 | 96.5 | 94.4 | 93.7 | 92.5 |
| | 8.7 | 99.6 | 98.4 | 97.9 | 97.5 | 97.1 | 95.4 | 94.4 | 93.0 |
| | 9.3 | 99.4 | 99.0 | 98.5 | 98.2 | 97.9 | 97.1 | 95.3 | 94.7 |
| SFO | 8.4 | 99.5 | 97.9 | 97.4 | 97.1 | 96.6 | 95.3 | 94.0 | 93.2 |
| | 8.7 | 99.4 | 98.4 | 98.1 | 97.4 | 97.1 | 95.6 | 95.0 | 93.7 |
| | 9.3 | 99.7 | 98.7 | 98.4 | 97.9 | 97.7 | 97.6 | 96.6 | 95.1 |
| RSO/ | 8.4 | 99.5 | 97.4 | 96.4 | 95.9 | 95.1 | 93.7 | 92.2 | 91.1 |
| EHC | 8.7 | 99.4 | 97.9 | 97.4 | 96.8 | 96.8 | 95.0 | 93.8 | 92.2 |
| (1:1) | 9.3 | 99.5 | 98.9 | 99.2 | 98.2 | 97.7 | 96.3 | 94.8 | 94.2 |

TABLE 5a-continued

| Solvent | CF surface pH | CI after stated no. of days development 0 | 1 | 2 | 3 | 4 | 7 | 14 | 24 |
|---|---|---|---|---|---|---|---|---|---|
| OLO | 8.4 | 99.7 | 99.4 | 97.1 | 96.3 | 96.6 | 93.5 | 91.5 | 90.5 |
| | 8.7 | 98.2 | 98.8 | 98.1 | 97.5 | 97.1 | 94.9 | 93.0 | 92.2 |
| | 9.3 | 99.7 | 99.3 | 99.0 | 98.5 | 98.1 | 96.5 | 95.3 | 94.0 |
| SAFO | 8.4 | 99.8 | 98.6 | 98.3 | 97.8 | 95.7 | 93.9 | 92.6 | 91.5 |
| | 8.7 | 99.8 | 99.0 | 98.6 | 98.3 | 97.5 | 95.8 | 94.6 | 93.6 |
| | 9.3 | 99.8 | 99.1 | 99.0 | 98.9 | 97.9 | 96.7 | 95.7 | 93.9 |

TABLE 5b

| Solvent | CF surface pH | Reflectance after 8 hours fade testing after stated no. of days development 0 | 1 | 2 | 3 | 4 | 7 | 14 | 24 |
|---|---|---|---|---|---|---|---|---|---|
| CNO | 8.4 | 88.9 | 88.5 | 88.2 | 87.9 | 88.2 | 87.0 | 82.3 | 81.0 |
| | 8.7 | 89:5 | 90.2 | 89.6 | 88.6 | 89.4 | 87.7 | 84.3 | 84.8 |
| | 9.3 | 93.4 | 91.8 | 90.0 | 91.0 | 90.7 | 90.6 | 88.6 | 87.6 |
| RSO | 8.4 | 86.0 | 85.2 | 86.4 | 85.5 | 86.1 | 83.3 | 85.4 | 85.1 |
| | 8.7 | 87.9 | 87.3 | 88.0 | 86.8 | 86.8 | 84.1 | 85.9 | 85.6 |
| | 9.3 | 89.8 | 89.4 | 90.3 | 88.7 | 89.2 | 86.6 | 87.4 | 87.2 |
| SFO | 8.4 | 93.8 | 90.7 | 91.1 | 90.2 | 90.6 | 88.9 | 89.1 | 88.9 |
| | 8.7 | 94.6 | 91.6 | 91.7 | 90.5 | 91.1 | 89.1 | 89.6 | 89.2 |
| | 9.3 | 95.6 | 92.6 | 93.1 | 91.8 | 92.1 | 90.6 | 90.8 | 90.5 |
| RSO/ | 8.4 | 90.4 | 87.2 | 86.8 | 86.7 | 86.4 | 85.8 | 86.4 | 86.3 |
| EHC | 8.7 | 91.9 | 87.7 | 88.1 | 87.5 | 88.2 | 86.4 | 87.3 | 87.0 |
| (1:1) | 9.3 | 93.1 | 88.9 | 90.5 | 89.2 | 89.1 | 87.7 | 88.2 | 87.9 |
| OLO | 8.4 | 92.3 | 91.4 | 91.3 | 90.6 | 91.2 | 89.5 | 89.3 | 89.8 |
| | 8.7 | 92.6 | 93.1 | 92.1 | 91.1 | 91.1 | 90.0 | 89.9 | 90.2 |
| | 9.3 | 93.7 | 94.2 | 93.5 | 92.4 | 92.2 | 91.1 | 91.2 | 91.5 |
| SAFO | 8.4 | 91.6 | 92.1 | 92.0 | 90.6 | 91.7 | 90.1 | 90.1 | 88.7 |
| | 8.7 | 92.1 | 93.0 | 92.1 | 91.0 | 92.5 | 90.5 | 90.9 | 90.3 |
| | 9.3 | 93.1 | 94.1 | 93.1 | 92.9 | 92.7 | 92.5 | 92.0 | 91.1 |

It will be seen from the tables that the performance of the lower surface pH papers was better than that of the higher surface pH paper.

EXAMPLE 6

This further illustrates the use of chromogenic materials (II), (IV), (IX) and (X) encapsulated as a 1% solution in RSO in combination with colour developer papers as used in Example 5, i.e. acid clay papers of surface pH values 8.4, 8.7, and 9.3, The procedure employed was as in Example 3, and the results obtained were as set out in Table 6:

TABLE 6

| Chromogenic Material | CF Surface pH | CI 2 min | 48 h | Reflectance after fading for: 4 hr | 8 hr | 16 hr | 32 hr |
|---|---|---|---|---|---|---|---|
| (II) | 8.4 | 99.6 | 98.3 | 93.1 | 92.9 | 93.9 | 93.9 |
| | 8.7 | 99.3 | 98.9 | 92.3 | 92.3 | 94.0 | 94.0 |
| | 9.3 | 99.5 | 98.2 | 90.4 | 91.3 | 93.8 | 93.8 |
| (IV) | 8.4 | 92.8 | 85.6 | 87.4 | 90.1 | 92.1 | 93.3 |
| | 8.7 | 95.1 | 85.5 | 87.4 | 90.4 | 92.8 | 94.1 |
| | 9.3 | 97.5 | 85.9 | 88.7 | 92.6 | 94.7 | 95.6 |
| (IX) | 8.4 | 93.4 | 94.1 | 94.9 | 96.7 | 97.5 | 97.7 |
| | 8.7 | 95.0 | 95.2 | 95.6 | 97.2 | 97.9 | 98.0 |
| | 9.3 | 97.4 | 96.8 | 96.9 | 98.1 | 98.6 | 98.7 |
| (X) | 8.4 | 90.6 | 83.5 | 83.6 | 85.7 | 88.3 | 88.3 |
| | 8.7 | 93.5 | 83.7 | 83.8 | 86.5 | 89.1 | 89.1 |
| | 9.3 | 96.9 | 84.5 | 84.6 | 87.8 | 90.8 | 90.8 |

It will be seen that benefits were obtained with the lower pH CF papers for all chromogenic materials except chromogenic material (II). This confirms the anomalous behaviour of chromogenic material (II) discussed earlier.

In similar experiments using conventional acid-sized carbonless base paper, benefits were also observed, although these were not as marked as those obtained in the Examples set out above. The benefits were assessed visually, and no quantification was attempted.

We claim:

1. Pressure-sensitive copying material comprising a sheet support carrying isolated droplets of an oil solution of chromogenic materials, said droplets being confined within respective pressure-rupturable barriers, and, on the opposite surface of the same sheet or on a different sheet support, a coating of an inorganic colour developer material effective to develop the colour of the chromogenic materials in said solution on contact therewith, at least one of said chromogenic materials having the characteristic of developing colour immediately on contact with the colour developer, wherein:

a) the oil solution comprises vegetable oil solvent;

b) the solution of chromogenic materials includes at least one chromogenic material which is relatively slower in developing colour on contact with the colour developer than the above-mentioned immediately-developing chromogenic material(s); and c) the surface pH of the colour developer coating is not more than about 8.7.

2. Pressure-sensitive copying material as claimed in claim 1, wherein said surface pH is not more than 8.5.

3. Pressure-sensitive copying materials as claimed in claim 1 wherein the solvent for the chromogenic material consists essentially of vegetable oil and, optionally, a fatty acid ester or other mono- or di-functional ester of a non-aromatic mono-carboxylic acid having a saturated or unsaturated straight or branched hydrocarbon chain with at least three carbon atoms in the chain.

4. Pressure-sensitive copying material as claimed in claim 1 wherein said sheet support is alkaline-or neutral-sized paper.

5. Pressure-sensitive copying material as claimed in claim 1 including a chromogenic material comprising a mono-carbazolyl diphenyl methane derivative.

6. A pressure-sensitive copying material according to claim 5, wherein said chromogenic material comprises N-butylcarbazol- 3-yl-bis(4-N-methyl-N-phenylaminophenyl) methane.

7. Pressure-sensitive copying material as claimed in claim 1 wherein the vegetable oil solvent is solid or semi-solid at room temperature.

8. Pressure-sensitive copying material as claimed in claim 7 wherein the vegetable oil solvent is coconut oil optionally blended with hardened coconut oil or another hardened solid oil.

9. Pressure-sensitive copying material as claimed in claim 1 wherein the inorganic colour developer material is an acid clay.

10. Pressure-sensitive copying material as claimed in claim 1 wherein the inorganic colour developer material is a synthetic alumina/silica material.

11. Pressure-sensitive copying material as claimed in claim 1, wherein said surface pH is not more than 8.4.

12. A method of enhancing imaging performance of pressure-sensitive copying material comprising adjusting and/or maintaining the colour developer surface pH of a pressure-sensitive material to not more than about 8.7, said pressure-sensitive copying material comprising a vegetable oil solvent, at least one relatively slow-developing chromogenic material, and an inorganic colour developer material coating.

* * * * *